United States Patent [19]

Gregory

[11] Patent Number: 4,520,648

[45] Date of Patent: Jun. 4, 1985

[54] LEVER OPERATED RIVETER

[75] Inventor: Jack T. Gregory, Penngrove, Calif.

[73] Assignee: Gregory Tool Systems, Inc., Sonoma, Calif.

[21] Appl. No.: 576,022

[22] Filed: Feb. 1, 1984

[51] Int. Cl.[3] ..... B21D 31/00

[52] U.S. Cl. ..... 72/391; 72/409; 29/243.53; 29/268; 81/355

[58] Field of Search ..... 72/391, 114, 453.17, 72/409; 29/243.53, 268; 81/9 A, 9 R, 354, 355

[56] References Cited

U.S. PATENT DOCUMENTS

| | | | |
|---|---|---|---|
| 429,961 | 6/1890 | Robbins | 72/409 |
| 1,475,273 | 11/1923 | Bernard | 81/9.5 R |
| 1,566,297 | 12/1925 | Williams | 81/9.5 R |
| 3,561,249 | 2/1971 | Freeman | 72/391 |
| 3,964,350 | 6/1976 | Casadio | 81/9.5 A |
| 4,136,547 | 1/1979 | Ewig, Jr. et al. | 72/391 |

FOREIGN PATENT DOCUMENTS

| | | | |
|---|---|---|---|
| 608564 | 11/1960 | Canada | 29/268 |
| 2739166 | 3/1979 | Fed. Rep. of Germany | 29/268 |

*Primary Examiner*—Daniel C. Crane
*Assistant Examiner*—David B. Jones
*Attorney, Agent, or Firm*—Melvin R. Stidham

[57] ABSTRACT

A mechanical riveter comprising a slideway with rivet-gripping jaw assembly slidable in said slideway to be pulled by a rod. A pivot and guide pin at the other end of the slideway pivotally carries a pair of squeezable handles and a pair of links, each pivoted between a handle and the end of the rod, so that when the handles are squeezed, the links pull the rod down and away from the nosepiece, guided through a bore through the pivot guide pin.

3 Claims, 2 Drawing Figures

LEVER OPERATED RIVETER

BACKGROUND OF THE INVENTION

There is presently being offered for sale a line of manually operated hydraulic riveters, such as those shown in my prior U.S. Pat. Nos. 4,263,801 and 4,248,077, as well as a simplified version, which is operated by a conventional power wrench, the latter being described and claimed in my co-pending application Ser. No. 556,920 filed Dec. 1, 1983, now U.S. Pat. No. 4,489,471. To supplement these lines, there remains a market for a low cost mechanical tool that has sufficient pulling power to function as a blind riveter.

OBJECTS OF THE INVENTION

It is an object of this invention to provide a manually operated mechanical riveter.

It is a further object of this invention to provide a manually operated pulling tool with sufficient mechanical advantage to function as a blind riveter.

It is a further object of this invention to provide a mechanical riveter that is relatively inexpensive, but reliable in operation.

Other objects and advantages of this invention will become apparent from the description to follow, particularly when read in conjunction with the accompanying drawing.

SUMMARY OF THE INVENTION

The mechanical riveter of this invention includes a gripping and pulling member that is longitudinally slideable along a slideway away from a nosepiece that is fixed to one end of the slideway. The pulling member is carried on a rod which is slideably guided through a circular hole in a guide pin, which is secured at the other end of the slideway. A pair of handles are pivoted directly on the guide pin to be squeezed in operating the riveter, and there are a pair of links, each of which is pivoted at one end to one of the handles and at the other end to the end of the rod so that when the handles are squeezed together the rod is pulled down, away from the nosepiece. A pair of jaws with conical outer surfaces are contained within a complementary collar carried on the slideable rod so that, as the rod is pulled down, it first pulls the collar down tightly over the jaws to clamp them tightly around the shank of a rivet, and then the collar carries the jaws and rivet shank with it, while the nosepiece holds the rivet head against a workpiece, until the rivet is set and the shank separated from it.

DESCRIPTION OF A PREFERRED EMBODIMENT

Figure 1:
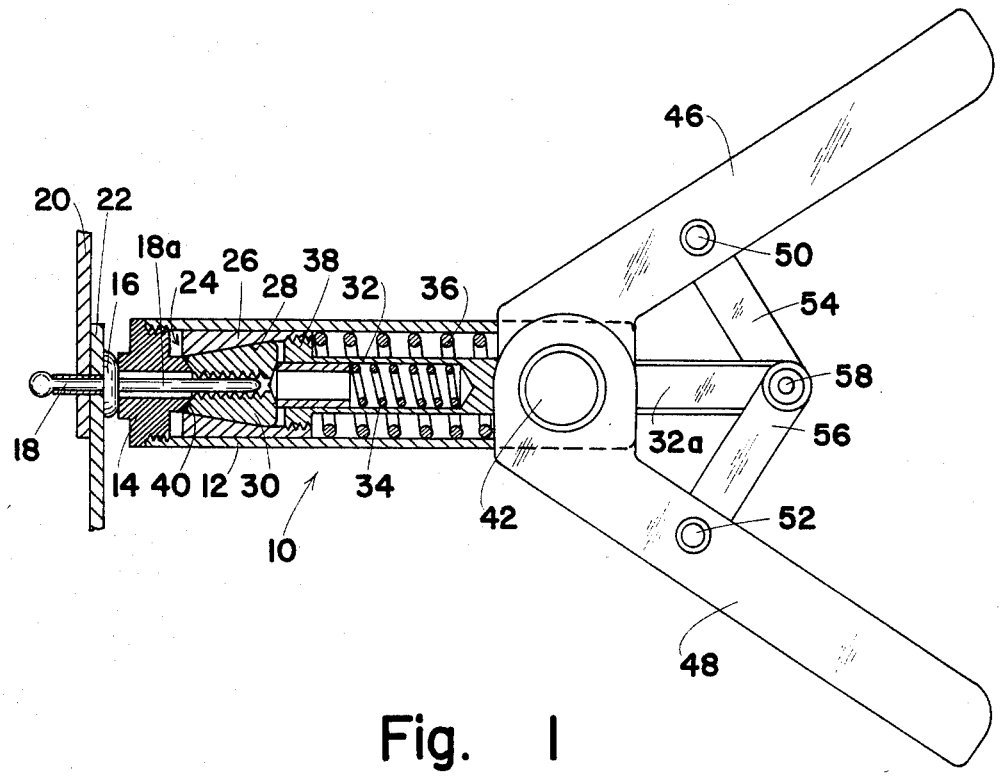
FIG. 1 is a section view of the mechanical riveter of this invention in its retracted configuration.

Referring now to the drawings with greater particularity, the lever-operated riveter 10 of this invention includes a cylindrical housing or slideway 12 on the end of which a nosepiece 14 is threaded or otherwise secured to engage against the head 16 of a blind rivet extending through work-pieces 20 and 22 to be secured together.

Slideably carried in the cylindrical housing 12 is a gripping and pulling member 24, including a collar 26 having a conical inner surface 28. Carried in the collar 28 are two more jaw segments 30 with complementary conical outer surfaces. The collar 26 is carried on the end of a pull rod 32, and a spring 34 in a cavity within the rod 32 biases the jaws 30 outward to slide along the conical surfaces 26 and grip the shank 18*a* of the rivet 18. Normally, a stronger spring 36 is carried in the housing 12 biases agaist a collar 38 on the end of the rod 32 to force a collar 26 forward while the jaws 30 are restrained by a stop member 40, to release the jaws.

Carried at the end of the housing 12 opposite from that of the nosepiece 14 is a guide and pivot pin 42 having a guide bore 44 diametrically therethrough to receive and guide the pull rod 32, and pivotally carried on the pivot pin 14 is a pair of squeezable handles 46 and 48. Pivoted at 50 and 52 to the handles 46 and 48 respectively are links 54 and 56, both of which are pivoted at 58 to a flattened segment 32*a* of the rod 32.

Hence, it is apparent that the pivot pin 42 functions both as a pivot for the handles 46 and 48 and as a guide for the rod 32 to provide a very compact tool with high mechanical advantage.

Figure 2:
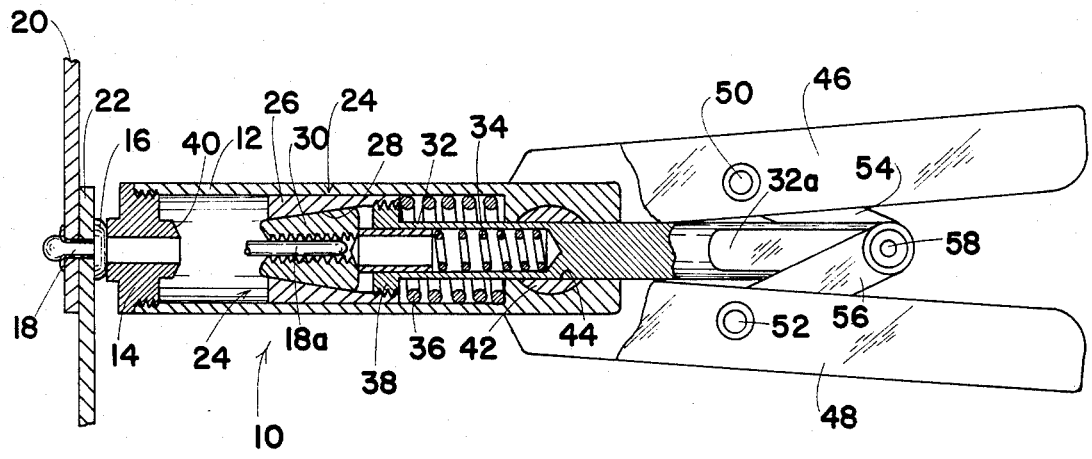
FIG. 2 is a section view of the riveter in its extended configuration.

In operation, the tool is held with its nosepiece 14 pressed against the head 16 of the blind rivet 18, then, the handles are squeezed. In its first movement, the wedging collar 26 slides back over the jaws 30 to clamp them tightly against the shank 18*a* of the rivet and, with continuous squeezing, the rivet jaws 30 pull the rivet shank 18*a* back to set, the rivet, as shown in FIG. 2, then to sever the shank itself. When the handles are released, the main spring 36 drives the collar forward until the stop member 40 retracts the jaws, to release the shank 18*a*, conditioning the tool 10 for the next operation.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A mechanical pulling tool comprising:

a slideway;

a nose piece carried on one end of said slideway to press against a surface;

a gripping member slidable along said slideway to pull a work-piece away from said surface;

a pair of squeezable handles pivoted about a common axis on the other end of said slideway;

a rod carrying said gripping member at one end thereof and extending rearward through said common axis and between said handles, with the other end thereof being located rearward of said other end of said slideway, said rod being encompassed by said slideway; and a pair of links, each pivoted at one end to one of said handles near said common axis, and extending inward of said handles and rearward of said common axis to pivot at the other end thereof to said other end of the rod so that squeezing said handles extends said links to pull said rod and gripping member away from said nose piece.

2. The pulling tool defined by claim 1 wherein said gripping member comprises:

a collar with a conical inner surface fixed to said one end of the rod;

at least two jaws having complementary conical outer surfaces axially movable in said collar; and first spring means biasing said jaws toward said one end to increase wedging action thereof.

3. The pulling tool defined by claim 1 including:

a pivot pin secured across said slideway on said common axis;

said handles being pivotable on said pivot pin; and means forming a hole extending diametrically through said pivot pin;

said rod extending through said hole and being slidably guided thereby.

* * * * *